US006533113B2

(12) United States Patent
Moscovitz

(10) Patent No.: US 6,533,113 B2
(45) Date of Patent: Mar. 18, 2003

(54) SYSTEM, DEVICES AND METHODS FOR STORING AND MIXING SUBSTANCES

(76) Inventor: Brett Moscovitz, 320 E. South St., Suite 180, Orlando, FL (US) 32801

( * ) Notice: Subject to any disclaimer, the term of this patent is extended or adjusted under 35 U.S.C. 154(b) by 0 days.

(21) Appl. No.: 09/875,807

(22) Filed: Jun. 6, 2001

(65) Prior Publication Data

US 2002/0066679 A1 Jun. 6, 2002

Related U.S. Application Data

(63) Continuation-in-part of application No. 09/870,847, filed on May 31, 2001.

(60) Provisional application No. 60/250,719, filed on Dec. 1, 2000, and provisional application No. 60/275,777, filed on Mar. 14, 2001.

(51) Int. Cl.[7] ..... B65D 25/08; B67D 5/00

(52) U.S. Cl. ..... 206/222; 215/DIG. 8; 222/83

(58) Field of Search ..... 222/83, 129; 206/219, 206/221, 222; 215/DIG. 8

(56) References Cited

U.S. PATENT DOCUMENTS

| | | | | |
|---|---|---|---|---|
| 2,487,236 A | | 11/1949 | Greenberg | |
| 2,885,104 A | | 5/1959 | Greenspan | |
| 3,404,811 A | | 10/1968 | Cernei | |
| 4,307,821 A | * | 12/1981 | McIntosh | 222/83 |
| 4,634,003 A | | 1/1987 | Ueda et al. | 206/221 |
| 4,747,501 A | * | 5/1988 | Greaves | 215/253 |
| 4,779,722 A | | 10/1988 | Hall | 206/221 |
| 4,898,293 A | | 2/1990 | Morel | 215/250 |
| 5,000,314 A | | 3/1991 | Fuller et al. | 206/221 |
| 5,209,565 A | | 5/1993 | Goncalves | 366/130 |
| 5,275,298 A | | 1/1994 | Holley, Jr. et al. | 215/11.4 |
| 5,277,303 A | | 1/1994 | Goyet et al. | 206/221 |
| 5,474,209 A | | 12/1995 | Vallet Mas et al. | 222/83 |
| 5,678,709 A | | 10/1997 | Holley et al. | 215/11.4 |
| 5,685,422 A | | 11/1997 | Kim | 206/222 |
| 5,769,215 A | | 6/1998 | Kim | 206/222 |
| 5,772,017 A | | 6/1998 | Kang | 206/222 |
| 5,782,345 A | | 7/1998 | Gausch et al. | 206/222 |
| 5,863,126 A | | 1/1999 | Guild | 366/130 |
| 5,927,549 A | | 7/1999 | Wood | 222/83 |
| 5,941,380 A | | 8/1999 | Rothman | 206/222 |
| 6,021,892 A | | 2/2000 | Baudin | 206/221 |
| 6,113,257 A | | 9/2000 | Sharon et al. | 366/130 |
| 6,138,821 A | * | 10/2000 | Hsu | 206/222 |
| 6,152,296 A | * | 11/2000 | Shih | 206/222 |

FOREIGN PATENT DOCUMENTS

| | | | | |
|---|---|---|---|---|
| JP | 6-80166 | * | 3/1994 | 206/222 |

* cited by examiner

*Primary Examiner*—Bryon P. Gehman
(74) *Attorney, Agent, or Firm*—Allen, Dyer, Doppelt, Milbrath & Gilchrist, P.A.

(57) ABSTRACT

The system is for separately storing and mixing first and second substances. The system includes a container for storing the the second substance and a device for storing the first substance. The device has an insertion portion for being inserted into an opening of the container, and the insertion portion has an opening and a breakable seal adjacent the opening for sealing the first substance in the device. Also, a breaking member is carried by the container and recessed inside the opening thereof for breaking the breakable seal of the device when engaged with the container to allow mixing of the first and second substances in the container.

17 Claims, 3 Drawing Sheets

SYSTEM, DEVICES AND METHODS FOR STORING AND MIXING SUBSTANCES

RELATED APPLICATIONS

This patent application is a continuation-in-part of copending application entitled "DEVICE FOR STORING AND DISPENSING A SUBSTANCE BY MATING WITH A CONTAINER AND ASSOCIATED METHODS" filed May 31, 2001 by the same inventor and having Ser. No. 09/870,847 which is based upon and claims priority to copending provisional application No. 60/250,719 filed Dec. 1, 2000 and No. 60/275,777 filed Mar. 14, 2001, the entire disclosures of each of which are incorporated herein by reference.

FIELD OF THE INVENTION

The present invention relates to containers, and, more particularly, to storing and mixing premeasured quantities of a substance.

BACKGROUND OF THE INVENTION

Beverage, food and drug manufacturers produce many different products which need to be or can be mixed with another substance, such as water, before consumption. Such products may include, for example, flavor syrups, powdered baby formula, powdered nutritional drink mix, liquor, suspension antibiotics or any other substance that could be mixed with another substance or liquid such as water, milk, juice or carbonated beverages, for example.

These products may be sold in bulk or as single servings packaged in cans, bottles, packets or other containers. Also, various containers have been designed for storing one or more of these products to be dispensed into another container such as a water bottle, baby bottle or cup. For example, U.S. Pat. No. 5,941,380 to Rothman, entitled "Device for Dispensing Flowable Material," discloses a storage cap having a receiving groove with a large diameter for mating with a number of different size bottle openings.

Furthermore, the storage cap has a rupturable membrane which can be ruptured as a bottle neck is urged into the receiving groove.

U.S. Pat. No. 5,529,179 to Hanson, entitled "Dispensing lid for beverage container," discloses a dispensing lid for the circular upper rim of a drinking cup. Frangible vessels contain condiments and are disposed within the lid. Condiments are released from the vessels when finger pressure is applied thereto.

U.S. Pat. No. 5,500,314 to Fuller et al., entitled "Unit Dose Package," discloses a unit dose storage cap for storing and dispensing a dose of infant and adult nutritional formulas. The cap has a threaded mouth designed to be fitted onto the wide neck of a infant formula bottle. A foil seal is removed before the storage cap is secured to the bottle. In another embodiment, the dose cap has a water soluble seal which dissolves into the formula bottle.

One problem with some of the conventional devices is that none provide a reliable seal that can be broken after the device is securely connected to a bottle. Additionally, none of the conventional devices provides a reliable member in the opening of the container for breaking the seal. Without a reliable seal, a reliable member for breaking the seal, and a secure connection between the device and the bottle, the seal may not be properly broken and/or the contents stored in the device may spill and/or be contaminated.

SUMMARY OF THE INVENTION

In view of the foregoing background, it is therefore an object of the invention to provide a system, method and device with a reliable seal that can be broken after the device is securely connected to a bottle.

It is also an object of the invention to provide a reliable breaking member in the opening of the container for breaking the seal when the device is inserted into the opening of the container.

This and other objects, features and advantages in accordance with the present invention are provided by a system for separately storing and mixing first and second substances, including a container for storing the the second substance, and having an opening with external threads, and a device for storing the first substance. The device has an insertion portion for being inserted into the opening of the container, and the insertion portion has an opening and a breakable seal adjacent the opening for sealing the first substance in the device. Also, a breaking member is carried by the container and recessed inside the opening thereof for breaking the breakable seal of the device when engaged with the container to allow mixing of the first and second substances in the container.

The breaking member may include a protruding portion and at least one opening therein. Also, the breaking member may be integrally formed with the container as a monolithic unit. Alternatively, the breaking member may be removable from the container and comprises a cylindrical housing which fits inside the opening of the container. The cylindrical housing of the breaking member preferably includes a lip for securing the breaking member within the opening of the container. The device may also include a threaded portion for mating with the external threads of the container. Such a threaded portion of the device preferably substantially surrounds the insertion portion. The device may also have a second opening and a cap for closing the second opening.

Objects, features and advantages in accordance with the present invention are also provided by a method of dispensing a first substance into a container for mixture with a second substance. The method includes storing the first substance in a chamber of a device having an insertion portion with an opening, and sealing the first substance in the chamber with a breakable seal adjacent the opening of the insertion portion. Furthermore, a breaking member is placed in an opening of the container, and the insertion portion of the device is inserted into the opening of the container having the breaking member placed therein to break the seal and allow mixing of the first and second substances in the container.

DETAILED DESCRIPTION OF THE PREFERRED EMBODIMENTS

Figure 1:
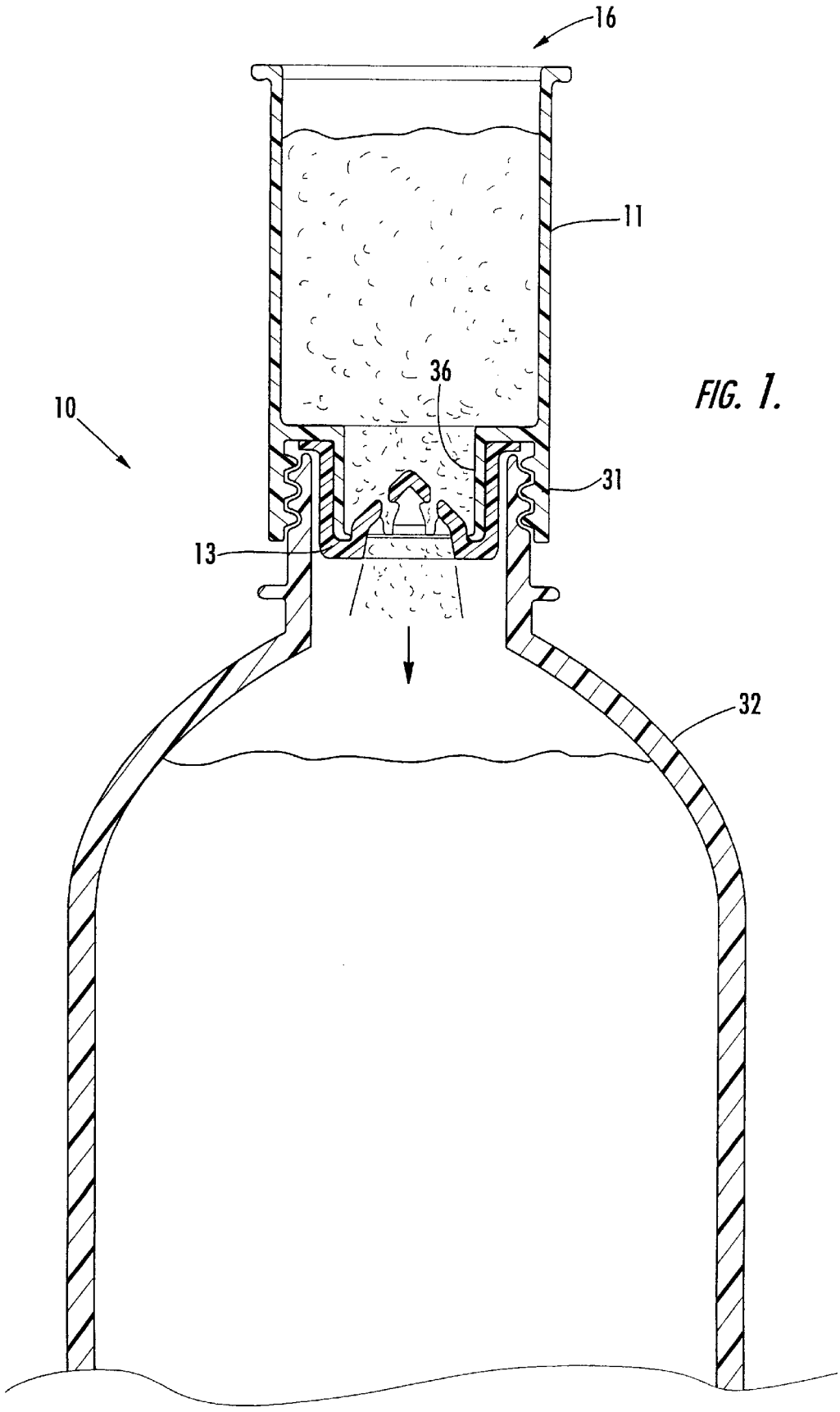
FIG. 1 is a cross-sectional view of a system including the device, breaking member and container of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring to FIGS. 1–4, an example of an embodiment of the system 10 will now be described. The system 10 is for separately storing and mixing first and second substances. The system 10 includes a container 32 for storing the the second substance, and having an opening 34 preferably with external threads 33. The system 10 also includes a device 11 for storing the first substance and having a first opening 14 and second opening 16 at opposite ends thereof and defining a chamber therein. The device 11 may include a threaded portion 31 with internal threads 15 for mating with the external threads 33 of a container 32 such as a water bottle. The threaded portion 31 may be integrally formed with the device 11 or may be separate from and secured to the outside of the device. The second opening 16 may include external threads for mating with a bottle cap or other appropriate closure for closing the device 11. The device 11 also includes a breakable or rupturable seal or inner wall member 22 disposed adjacent the opening 14 of the device 11.

The device 11 preferably has an insertion portion 36 for being inserted into the opening 34 of the container 32. The insertion portion 36 includes the opening 14 and the breakable seal 22 adjacent the opening for sealing the first substance in the device 11. The threaded portion 31 of the device 11 preferably substantially surrounds the insertion portion 36.

The system 10 further includes a breaking member 13 which is preferably carried by the container 32 and recessed inside the opening 34 thereof. The breaking member 13 may be secured within the opening 34 of the container 32 via one or more tabs or a friction fit, for example. The breaking member 13 may also be secured within the opening 34 via a snap fit, receiving grooves, protruding rings or any other fitting that would reliably secure the breaking member within the opening.

Figure 2:
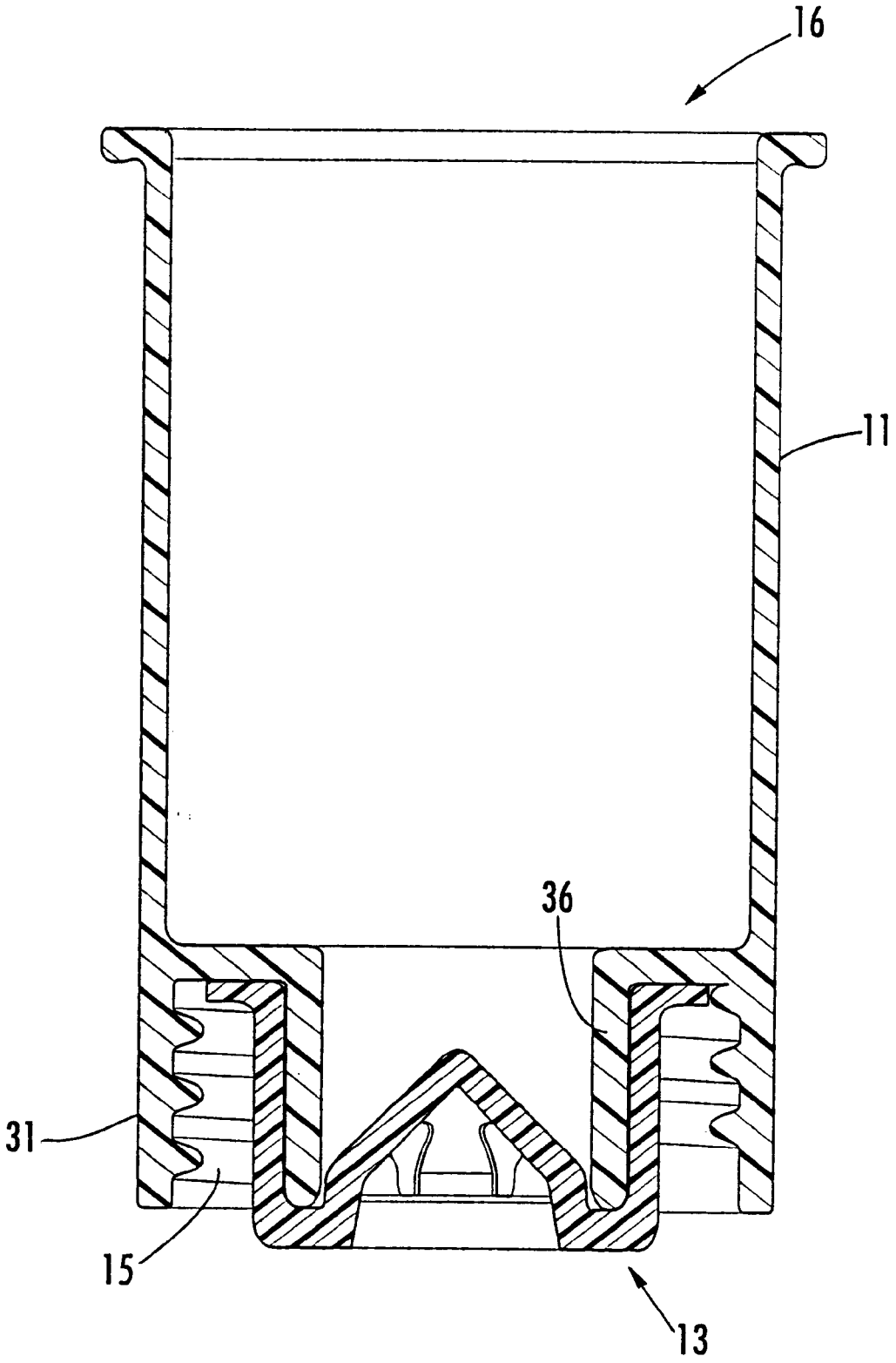
FIG. 2 is a cross-sectional view of the device and breaking member of FIG. 1.
Figure 4:
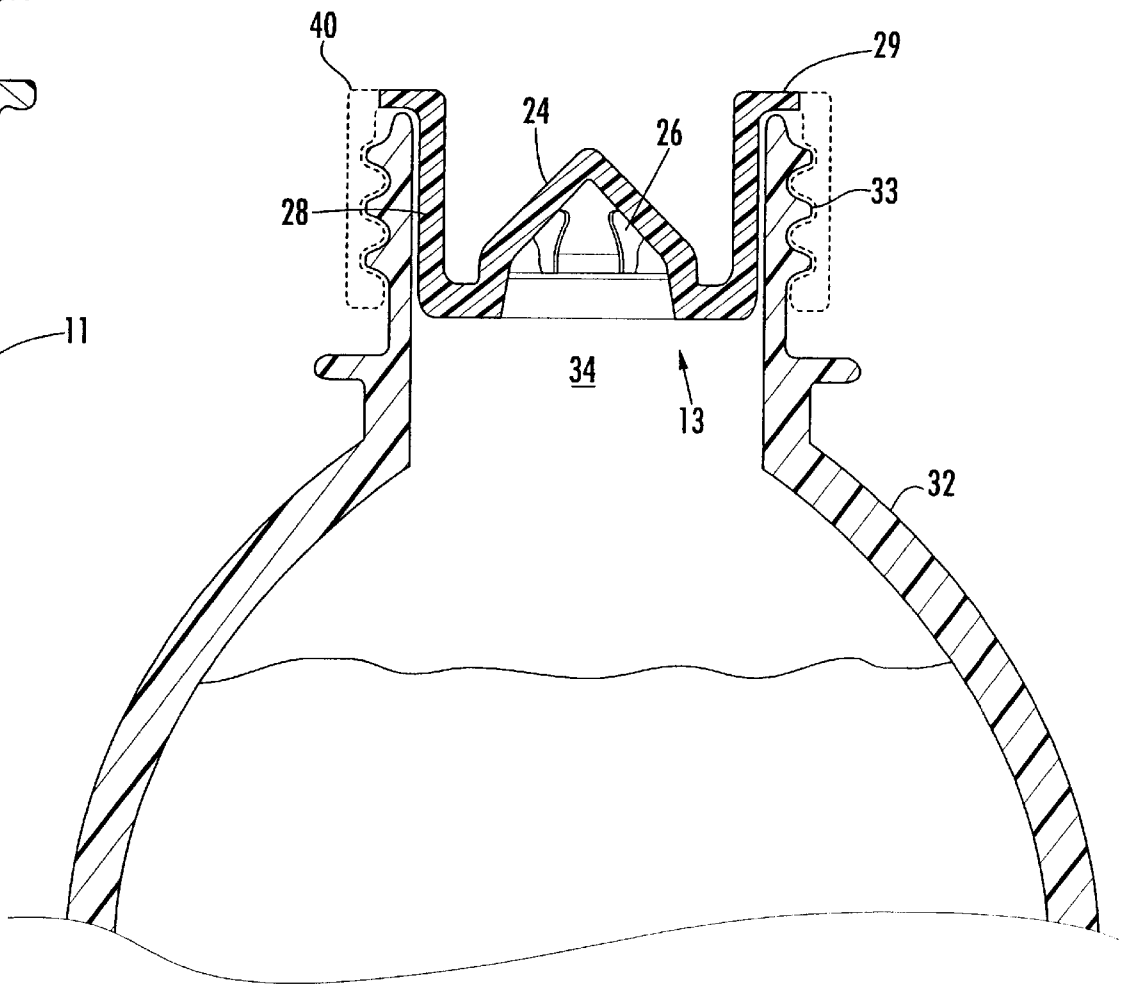
FIG. 4 is a cross-sectional view of the breaking member of FIG. 1 placed in the opening of the container.
Figure 3:
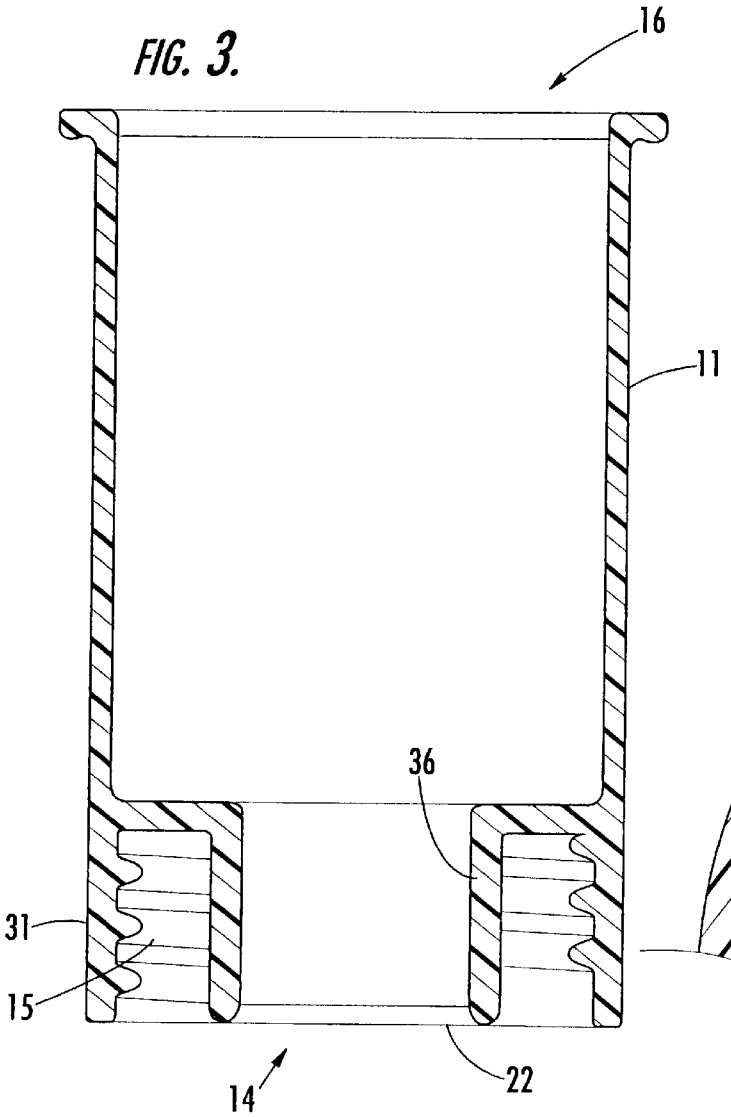
FIG. 3 is a cross-sectional view of the device of FIG. 1.

The breaking member 13 preferably includes a protruding portion 24 and openings 26 therein. As shown in FIGS. 2 and 4, the breaking member 13 may be removable from the container 32 and comprises a cylindrical housing 28 which fits inside the opening 34 of the container. The cylindrical housing 28 of the breaking member preferably includes a lip 29 for securing the breaking member within the opening 34 of the container 32. At a desired time, e.g. after the container 32 has been filled with the second substance at a processing plant, the breaking member 13 is placed into the opening 34 of the container. The container 32 is preferably a bottle of water or other beverage. A container cap may then be placed on the container 32 to close the opening 34 with the breaking member 13 therein. Alternatively, the breaking member 13 may be inserted into the opening by a consumer after purchasing the container 32 with the second substance stored therein. Furthermore, the breaking member 13 may be integrally formed with the container 32 as a monolithic unit.

The device 11 may then be screwed on to the container 32 via threaded portion 31 and is driven toward the breaking member 13. As such, the protruding portion 24 of the breaking member 13 begins to press on the seal 22 until such seal 22 is broken, ruptured, pierced, split etc., to expose the substance in the device 11 to the liquid in the container 32 to produce a mixture. Of course the connected device 11 and container 32 may be shaken or swirled to aid in the mixing of the substance and the liquid.

Additionally, the breaking member 13 may include an outer housing threaded portion 40 as shown by dotted lines in FIG. 4. This embodiment would further secure the breaking member 13 within the opening 34 of the container 32. Such an outer housing threaded portion 40 may also include external threads for mating with a cap to close the opening 34. Of course the respective threads may be reversed with respect to the threads of the container opening 34. The device 11 would also be threaded onto such a breaking member 13 via threaded portion 31. Also, the device 11 may be fitted over the breaking member 13 with the outer housing threaded portion 40 via one or more tabs, a friction fit, a snap fit, receiving grooves, protruding rings or any other fitting that would reliably secure the device to the breaking member.

The seal 22 may be a thinned wall portion and is preferably formed with lines of weakness to aid in the breaking or rupturing of the seal. The seal 22 may also be a membrane made of plastic, foil or any other material which would provide a reliable seal and be capable of opening, breaking, tearing, rupturing, splitting or ripping, for example, in response to pressure exterted by the protruding portion 24. Such a membrane may also be formed with lines of weakness to aid in the breaking or rupturing of the seal 22.

The system 10 in accordance with the present invention provides sterile and convenient mixing and storing of premeasured quantities of a substance and a liquid, thereby avoiding the possibility of spillage, contamination and the production of incorrect mixtures. Furthermore, because the breaking member 13 is recessed in the opening 34 of the container 32, and includes a plurality of openings 26, it may be included with the container 32 and provided or sold separately from the device 11. In other words, a consumer may be able to drink the liquid stored in the container 32 with the "lip-friendly" breaking member 13 in the opening 34. The devices 11 may be used to store powdered baby formula, diet drink powders, sports drink powders, liquor, pharmaceuticals or any other substance that would conveniently be stored and be ready to mix with another substance or liquid such as water, milk, juice or soda, for example.

The device 11 illustrated in FIGS. 1–4 includes an elongated and cylindrical shape, however, other shapes and sizes which provide storage for the desired premeasured quantity of a substance, are also contemplated by the inventors. The device 11 is preferably made of plastic, and may be transparent or opaque. The device 11 is preferably a single serving disposable device but may also be reusable depending on the type of seal 22 used. The size, depth and diameter of the device 11 will be based on serving volume requirements. Additionally, the device 11 may include multiple chambers and multiple insertion portions 31 for storing different substances. various types of safety or tamper resistant devices may also be appropriate.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A system for separately storing and mixing first and second substances, the system comprising:

a container for storing the second substance, the container having an opening with external threads;

a device for storing the first substance, the device having an insertion portion for being inserted into the opening of the container, the insertion portion having an opening and a breakable seal adjacent the opening for sealing the first substance in the device; and a breaking member carried by the container and recessed inside the opening thereof for breaking the breakable seal of the device when engaged with the container to allow mixing of the first and second substances in the container, the breaking member comprising a cylindrical housing which removably fits inside the opening of the container, and a protruding portion within the cylindrical housing, and including a plurality of openings therein and a peak centered among the plurality of openings.

2. A system according to claim 1, wherein the breaking member is integrally formed with the container as a monolithic unit.

3. A system according to claim 1, wherein the cylindrical housing of the breaking member comprises a lip for securing the breaking member within the opening of the container.

4. A system according to claim 1, wherein the device further comprises a threaded portion for mating with the external threads of the container.

5. A system according to claim 4, wherein the threaded portion of the device substantially surrounds the insertion portion.

6. A system according to claim 1, wherein the device has a second opening; and further comprising a cap for closing the second opening.

7. An apparatus for dispensing a substance into a container, the apparatus comprising:

a device for storing the substance, the device having an insertion portion for being insetted into the opening of the container, the insertion portion having an opening and a breakable seal adjacent the opening for sealing the substance in the device; and a breaking member for recessed placement in an opening of the container and for breaking the breakable seal of the device when engaged with the container to dispense the first substance into the container, the breaking member comprising a cylindrical housing which removably fits inside the opening of the container, and a protruding portion within the cylindrical housing, and including a plurality of openings therein and a peak centered among the plurality of openings.

8. An apparatus according to claim 7, wherein the cylindrical housing of the breaking member comprises a lip for securing the breaking member within the opening of the container.

9. An apparatus according to claim 7, wherein the device further comprises a threaded portion for mating with external threads at the opening of the container.

10. An apparatus according to claim 9, wherein the threaded portion of the device substantially surrounds the insertion portion.

11. An apparatus according to claim 7, wherein the device has a second opening; and further comprising a cap for closing the second opening.

12. A breaking member for recessed placement in an opening of a container, the breaking member comprising:

a cylindrical housing which removably fits inside the opening of the container;

a protruding portion carried by the cylindrical housing; and a plurality of openings in the protruding portion, and a peak centered among the plurality of openings.

13. A breaking member according to claim 12, wherein the cylindrical housing comprises a lip for securing the breaking member within the opening of the container.

14. A method of dispensing a first substance into a container for mixture with a second substance, the method comprising;

storing the first substance in a chamber of a device having an insertion portion with an opening;

sealing the first substance in the chamber with a breakable seal adjacent the opening of the insertion portion;

placing a breaking member in an opening of the container, the breaking member comprising a cylindrical housing which removably fits inside the opening of the container, and a protruding portion within the cylindrical housing, and including a plurality of openings therein and a peak centered among the plurality of openings; and inserting the insertion portion of the device into the opening of the container having the breaking member placed therein to break the seal and allow mixing of the first and second substances in the container.

15. A method according to claim 14, wherein the device includes a threaded portion; and wherein inserting the device into the container comprises threading the threaded portion of the device onto external threads at the opening of the container.

16. A method according to claim 14, wherein the cylindrical housing of the breaking member comprises a lip for securing the breaking member within the opening of the container.

17. A method according to claim 14, wherein the device has a second opening; and further comprising closing the second opening with a cap.

* * * * *